US008336748B2

(12) United States Patent
Hlinka et al.

(10) Patent No.: US 8,336,748 B2
(45) Date of Patent: Dec. 25, 2012

(54) FASTENER DRIVER WITH DRIVER ASSEMBLY BLOCKING MEMBER

(75) Inventors: Eric E. Hlinka, Roselle, IL (US); Chia Sheng Liang, Taipei (TW); Chu Hsiang Tseng, Taipei County (TW); Chin Lung Chang, Taoyuan County (TW)

(73) Assignee: Robert Bosch GmbH, Stuttgart (DE)

( * ) Notice: Subject to any disclaimer, the term of this patent is extended or adjusted under 35 U.S.C. 154(b) by 59 days.

(21) Appl. No.: 12/630,907

(22) Filed: Dec. 4, 2009

(65) Prior Publication Data

US 2011/0062208 A1 Mar. 17, 2011

Related U.S. Application Data

(63) Continuation-in-part of application No. 12/559,724, filed on Sep. 15, 2009.

(51) Int. Cl.

| | |
|---|---|
| ***B21J 15/28*** | (2006.01) |
| ***B27F 7/17*** | (2006.01) |
| ***B27F 7/00*** | (2006.01) |
| ***B25C 1/00*** | (2006.01) |

(52) U.S. Cl. ..... 227/8; 227/131

(58) Field of Classification Search ..... 227/2–8, 227/12, 129, 131–134, 156, 130, 137; 173/47
See application file for complete search history.

(56) References Cited

U.S. PATENT DOCUMENTS

| | | | | |
|---|---|---|---|---|
| 3,858,781 | A | 1/1975 | Obergfell et al. | |
| 4,042,036 | A * | 8/1977 | Smith et al. | 173/13 |
| 4,129,240 | A * | 12/1978 | Geist | 227/8 |
| 4,189,080 | A * | 2/1980 | Smith et al. | 227/8 |
| 4,197,974 | A | 4/1980 | Morton et al. | |
| 4,204,622 | A * | 5/1980 | Smith et al. | 227/7 |
| 4,544,090 | A * | 10/1985 | Warman et al. | 227/131 |
| 4,597,517 | A | 7/1986 | Wagdy | |
| 4,747,455 | A | 5/1988 | Cunningham | |
| 4,769,936 | A | 9/1988 | Miller | |
| 4,964,558 | A | 10/1990 | Crutcher et al. | |
| 5,020,712 | A * | 6/1991 | Monacelli | 227/8 |
| 5,180,091 | A | 1/1993 | Ota | |
| 5,373,795 | A * | 12/1994 | Kato | 112/236 |
| 5,593,079 | A | 1/1997 | Mukoyama et al. | |

(Continued)

OTHER PUBLICATIONS

DeWalt website page "18V Cordless XRP™ 1-1/4"-2-1/2" 16 Gauge 20° Angled Finish Nailer Kit—DC618K"; http://www.dewalt.com/us/products/tool_detail.asp?productID=8987; published at least as early as Nov. 17, 2009; (1 page).

*Primary Examiner* — Robert Long
(74) *Attorney, Agent, or Firm* — Maginot, Moore & Beck

(57) ABSTRACT

A device for driving a plurality of fasteners includes a driver assembly having a drive block, a flywheel and a driver mount. The driver mount is configured to move between a first position where the flywheel is removed from the drive block and a second position where the flywheel engages the drive block. The device also includes a work contact element configured to move between an extended position and a depressed position. A blocking arm is connected to the work contact element and configured to move with the work contact element. The blocking arm is positioned in a path of movement of the driver mount when the work contact element is in the extended position. The blocking arm is removed from the path of movement of the driver mount when the work contact element is in the depressed position.

16 Claims, 10 Drawing Sheets

U.S. PATENT DOCUMENTS 5,816,468 A 10/1998 Yang
6,012,622 A * 1/2000 Weinger et al. ..... 227/8
6,056,181 A 5/2000 Chuang
6,145,724 A 11/2000 Shkolnikov et al.
6,176,412 B1 * 1/2001 Weinger et al. ..... 227/142
6,179,192 B1 1/2001 Weinger et al.
6,267,284 B1 7/2001 Clark
6,592,014 B2 7/2003 Smolinski
6,609,646 B2 8/2003 Miller et al.
6,761,299 B2 7/2004 Caringella et al.
6,966,476 B2 11/2005 Jalbert et al.
7,000,294 B2 2/2006 Kakuda et al.
7,021,511 B2 4/2006 Popovich et al.
7,059,507 B2 6/2006 Almeras et al.
7,134,586 B2 11/2006 McGee et al.
7,140,524 B2 * 11/2006 Hung et al. ..... 227/8
7,165,305 B2 * 1/2007 Kenney et al. ..... 29/434
7,213,732 B2 * 5/2007 Schell et al. ..... 227/8
7,322,506 B2 * 1/2008 Forster ..... 227/133
7,328,826 B2 2/2008 Shkolnikov
7,331,403 B2 * 2/2008 Berry et al. ..... 173/1
7,575,141 B1 * 8/2009 Liang et al. ..... 227/131
7,641,089 B2 * 1/2010 Schell et al. ..... 227/120
7,677,425 B2 * 3/2010 Brendel et al. ..... 227/8
7,810,688 B2 * 10/2010 Wu et al. ..... 227/8
7,845,530 B2 * 12/2010 Schell et al. ..... 227/8
7,870,987 B1 * 1/2011 Zhang et al. ..... 227/8
7,905,377 B2 * 3/2011 Krondorfer et al. ..... 227/8
7,975,893 B2 * 7/2011 Berry et al. ..... 227/134
7,997,467 B2 * 8/2011 Hirabayashi et al. ..... 227/131
8,146,788 B2 * 4/2012 Hlinka et al. ..... 227/8
2003/0121948 A1 7/2003 Hsien
2005/0218176 A1 * 10/2005 Schell et al. ..... 227/8
2008/0073405 A1 * 3/2008 Shima et al. ..... 227/131
2008/0164295 A1 7/2008 Wu et al.
2008/0308592 A1 * 12/2008 Schell et al. ..... 227/8
2009/0020583 A1 1/2009 Kestner et al.
2009/0194573 A1 * 8/2009 Liang et al. ..... 227/131
2009/0321495 A1 * 12/2009 Hirabayashi et al. ..... 227/131
2010/0038396 A1 * 2/2010 Krondorfer et al. ..... 227/8
2010/0065294 A1 * 3/2010 Hirabayashi ..... 173/122
2010/0102102 A1 * 4/2010 Matsunaga et al. ..... 227/8
2010/0116863 A1 * 5/2010 Suda ..... 227/8
2010/0116866 A1 * 5/2010 Gross et al. ..... 227/131
2010/0155449 A1 * 6/2010 Shor ..... 227/8
2010/0206933 A1 * 8/2010 Wu et al. ..... 227/8
2010/0237124 A1 * 9/2010 Shima et al. ..... 227/8
2010/0258607 A1 * 10/2010 Lam et al. ..... 227/8
2010/0327037 A1 * 12/2010 Zhang et al. ..... 227/8
2011/0062207 A1 * 3/2011 Hlinka et al. ..... 227/8
2011/0062208 A1 * 3/2011 Hlinka et al. ..... 227/8
2011/0073630 A1 * 3/2011 Kakuda et al. ..... 227/8
2011/0132958 A1 * 6/2011 Hlinka et al. ..... 227/8
2011/0132959 A1 * 6/2011 Hlinka et al. ..... 227/8
2011/0315736 A1 * 12/2011 Leimbach et al. ..... 227/8

* cited by examiner

FASTENER DRIVER WITH DRIVER ASSEMBLY BLOCKING MEMBER

CROSS-REFERENCE TO RELATED APPLICATIONS

This application is a continuation-in-part of U.S. patent application Ser. No. 12/559,724, filed Sep. 15, 2009, the contents of which are incorporated herein by reference.

FIELD

This application relates to the field of power tools and particularly to devices used to drive fasteners into workpieces.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners to be driven into a work piece. Moreover, proper driving of larger fasteners into a work piece frequently requires more than a single impact from a manual tool.

In response to the shortcomings of manual driving tools, power-assisted devices for driving fasteners into work pieces have been developed. Contractors and homeowners commonly use such devices for driving fasteners ranging from brad nails used in small projects to common nails which are used in framing and other construction projects. Compressed air has been traditionally used to provide power for the power-assisted (pneumatic) devices. However, other power sources have also been used, such as DC motors.

Various safety features have been incorporated into pneumatic and other power nailers. One such device is commonly referred to as a work contact element (WCE). A WCE is incorporated into nail gun designs to prevent unintentional firing of the nail gun. A WCE is typically a spring loaded mechanism which extends outwardly from the portion of the nail gun from which a nail is driven. In operation, the WCE is pressed against a work piece into which a nail is to be driven. As the WCE is pressed against the work piece, the WCE compresses the spring and generates an axial movement which is transmitted to a trigger assembly. The axial movement is used to reconfigure a safety device, which is typically a trigger disabling mechanism, so as to enable initiation of a firing sequence with the trigger of the nail gun.

Since typical WCE arrangements in the past have included a mechanical linkage between the WCE and the trigger, it would be advantageous to provide an additional safety feature that is not necessarily linked with trigger operation. It would also be advantageous if such safety feature interacted with the firing mechanism to block operation of the firing mechanism if the WCE is not depressed.

SUMMARY

In accordance with at least one embodiment, a device for driving a plurality of fasteners includes a magazine configured to retain the plurality of fasteners and a driver assembly configured to provide an expulsion force that expels one of the plurality of fasteners from the magazine. The driver assembly includes a driver member configured to move along a path between a first position where the driver assembly is prevented from providing an expulsion force and a second position where the driver assembly is configured to provide the expulsion force. The device further includes a work contact element and a blocking member connected to the work contact element. The work contact element is moveable in a linear direction between an extended position and a depressed position. The blocking member is configured to move in the linear direction when the work contact element is moved in the linear direction. When the work contact element is in the extended position, the blocking member is positioned in the path of movement of the driver member and blocks the driver member from moving to the second position.

In at least one embodiment, a device for driving a plurality of fasteners includes a driver assembly having a drive block, a flywheel and a driver mount. The driver mount is configured to move between a first position where the flywheel is removed from the drive block and a second position where the flywheel engages the drive block. The device also includes a work contact element configured to move between an extended position and a depressed position. A blocking arm is connected to the work contact element and configured to move with the work contact element. The blocking arm is positioned in a path of movement of the driver mount when the work contact element is in the extended position and blocks the driver mount from moving to the second position. The blocking arm is removed from the path of movement of the driver mount when the work contact element is in the depressed position such that the driver mount is free to move to the second position.

In at least one embodiment, a device for driving a plurality of fasteners comprises a driver assembly including a drive block, a flywheel and a driver mount with a first blocking surface. The driver mount is configured to move between a first position where the flywheel is removed from the drive block and a second position where the flywheel engages the drive block. A work contact element is moveable between an extended position and a depressed position. A blocking arm is connected to the work contact element and configured to move between a blocking position when the work contact element is in the extended position and a pass-by position when the work contact element is in the depressed position. The blocking arm includes a second blocking surface that is configured to engage the first blocking surface of the driver mount and block the driver mount from moving from the first position to the second position when the work contact element is in the extended position. The second blocking surface is further configured to avoid engagement with the first blocking surface when the work contact element is in the depressed position and the driver mount is moved from the first position to the second position.

DESCRIPTION

Figure 1:
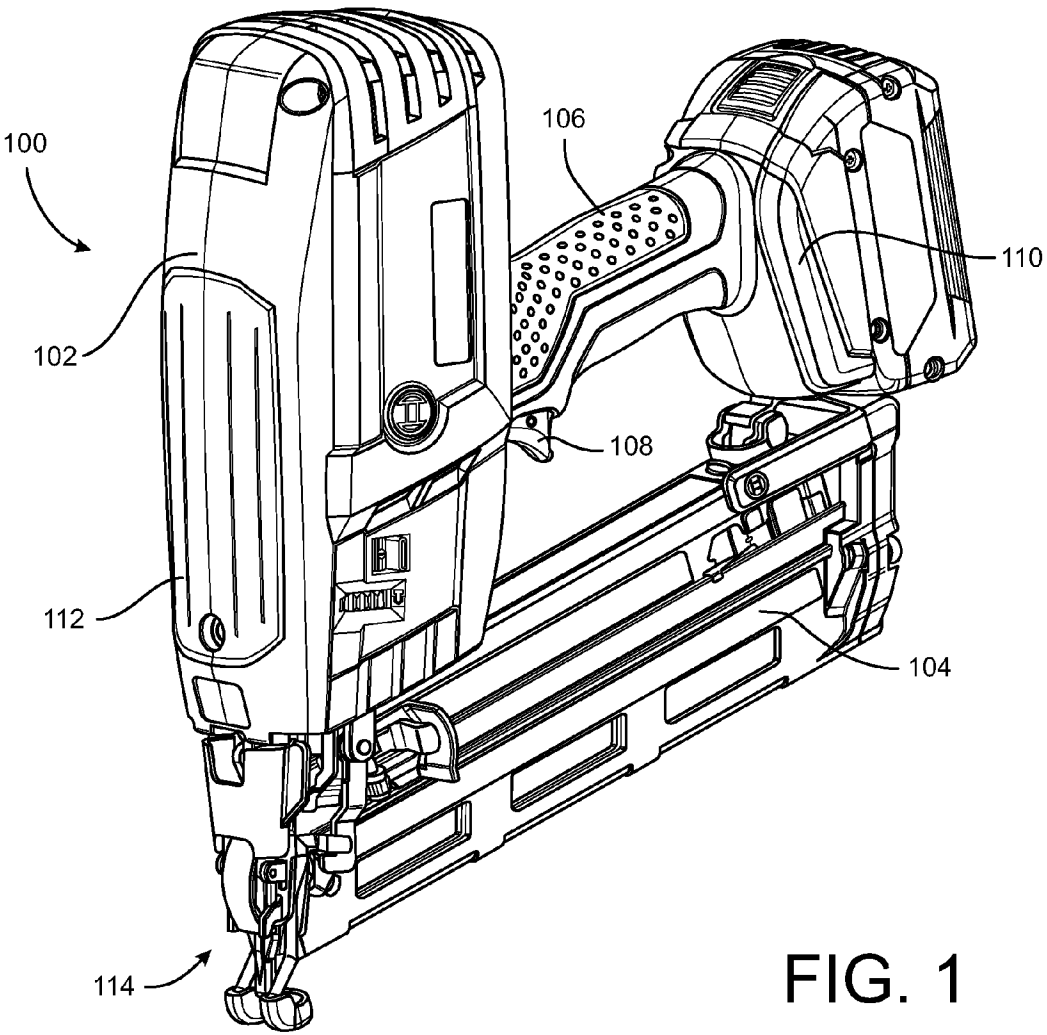
FIG. 1 depicts a side perspective view of an exemplary embodiment of a fastener driver with a driver assembly blocking member.

FIG. 1 depicts one embodiment of a device 100 for driving a fastener including a drive housing 102 and a fastener storage and feeding device 104. The term "magazine" is also used herein to refer to any such device used to store and/or feed fasteners, such as for example, the feeding device 104 shown in FIG. 1. The drive housing 102 defines a handle portion 106 from which a trigger 108 extends, a receptacle area 110 and a drive section 112. The fastener guide 104 in this embodiment is spring biased to force fasteners, such as nails or staples held in a cartridge or a clip, serially one after the other, into a loaded position adjacent the drive section 112. The receptacle area 110 may be used to connect a source of compressed air or other source of power (such as a battery) to the fastener driver device 100.

Figure 2:
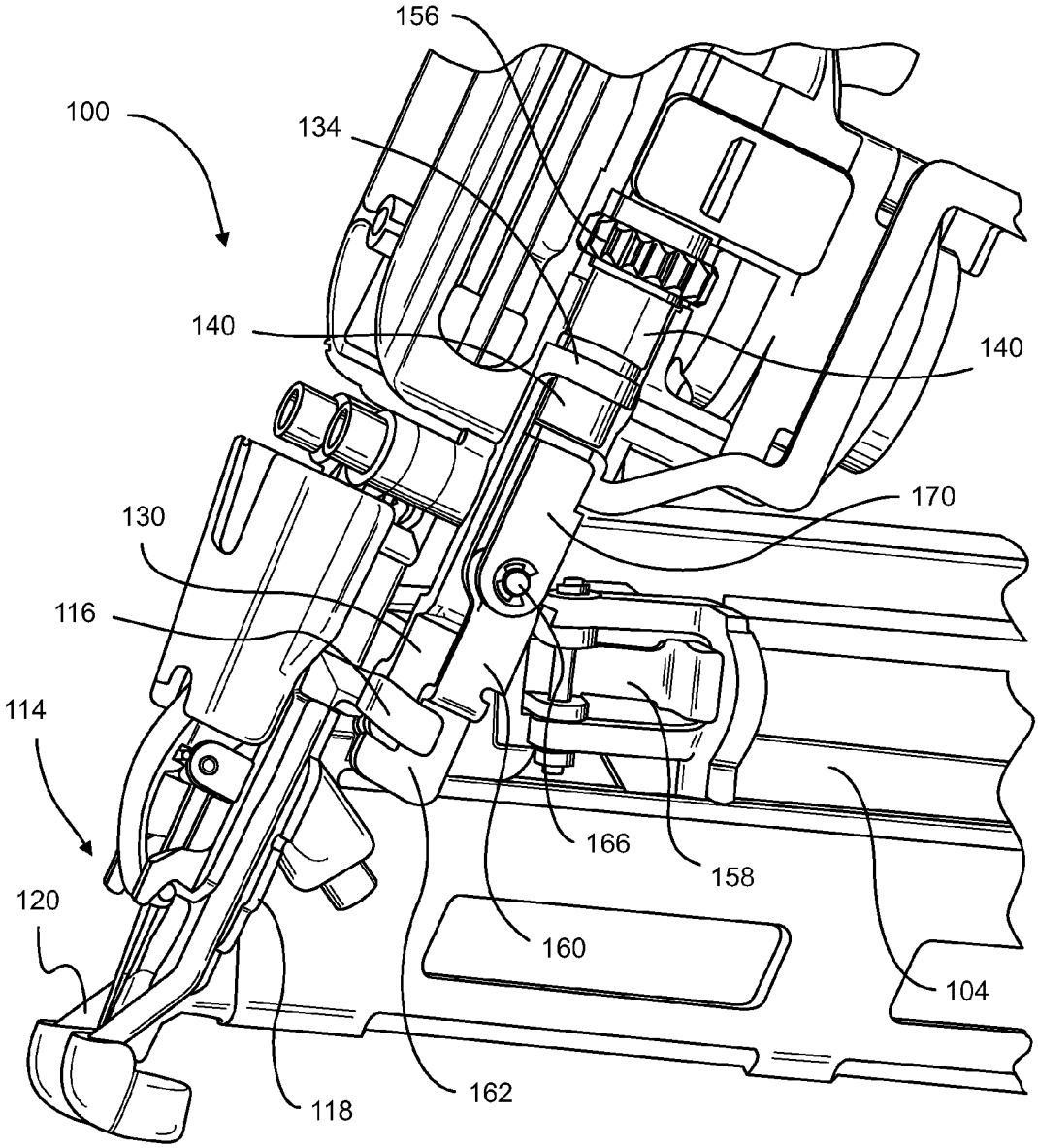
FIG. 2 depicts a cutaway side view of the nose assembly of the fastener driver of FIG. 1 with a work contact element in an extended position and coupled to a lockout assembly and a depth adjustment mechanism.
Figure 3:
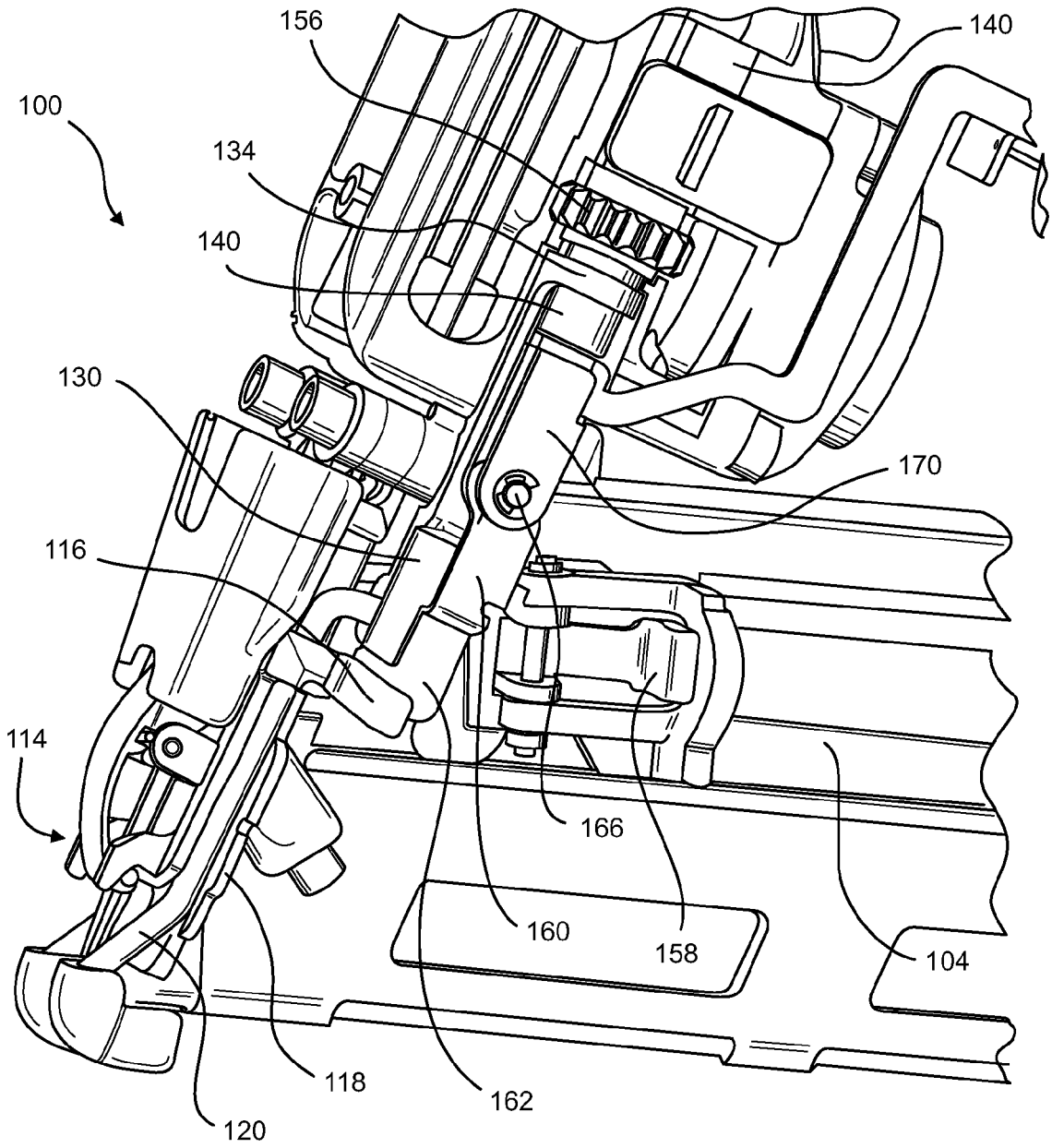
FIG. 3 depicts a cutaway side view of the nose assembly of the fastener driver of FIG. 1 with the work contact element in a depressed/retracted position.

Located adjacent to the drive portion 112 and the magazine 104 is a nose assembly 114. FIG. 2 shows a cutaway view of the nose assembly 114, the lower part of the drive portion 112, and an end portion of the magazine 104. The nose assembly 114 includes a work contact element (WCE) 120 configured to slide along a nose frame 118 which is fixed to the housing 102. The WCE 120 is configured to slide relative to the housing 102 and nose frame 118 between an extended position, as shown in FIG. 2, and a retracted/depressed position, as shown in FIG. 3. As mentioned previously, although the term WCE is used herein to refer to such safety devices that move when contacted with a work piece, it will be recognized that other names are commonly used for the WCE, such as a "contact trip".

Figure 4:
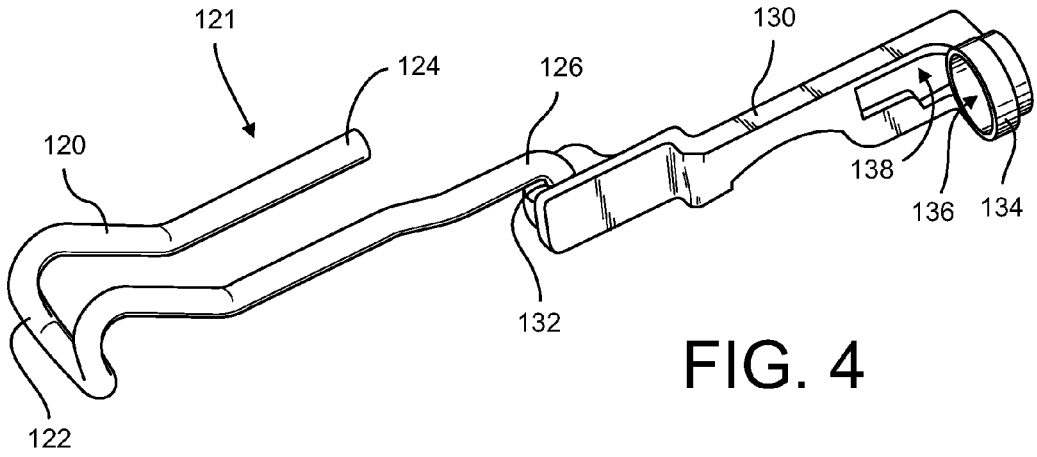
FIG. 4 depicts a perspective view of the work contact element assembly isolated from the other elements of FIG. 2.

As best shown in the isolation view of FIG. 4, the WCE 120 is connected to a WCE arm 130 to form the WCE assembly 121. In this embodiment, the WCE 120 is provided as a wireform bent in a shape such that a blunt contact tip 122 is formed between the two ends 124 and 126 of the wireform. One end 126 of the wireform is inserted in a slot 132 in the WCE arm 130 in order to rigidly connect the WCE 120 to the WCE arm 130.

With continued reference to FIG. 4, the WCE arm 130 includes a circular guide 134 on an end of the arm 130 opposite the slot 132. The circular guide 134 defines a hole 136 and the interior of this hole 136 is threaded. An opening 138 is also formed on the circular guide end of the WCE arm 130.

Figure 5:
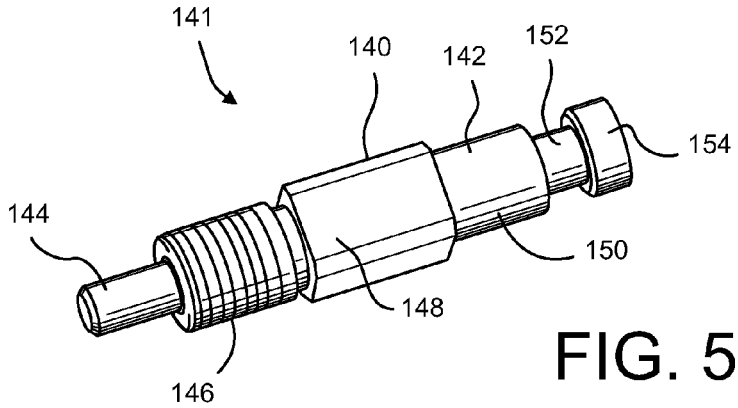
FIG. 5 depicts a perspective view of the depth adjustment mechanism isolated from the other elements of FIG. 2.

With reference now to the embodiment of FIGS. 2 and 5, the WCE assembly 121 is coupled to the depth adjustment mechanism 141. The depth adjustment mechanism 141 comprises a dial 156 (see FIG. 2) connected to a sleeve 140 that is rotatably positioned on a center rod 142. The center rod 142 includes a first cylindrical portion 144 connected to a second cylindrical portion 150. The second cylindrical portion 150 has a greater diameter than the first cylindrical portion 144 such that a shoulder is formed between the first portion 144 and the second portion 150. The center rod 142 also includes a neck 152, and a head 154.

The sleeve 140 is rotatably positioned on the center rod 142 with the first cylindrical portion 144 of the center rod 142 extending completely through the sleeve 140. The sleeve 140 includes a cylindrical threaded segment 146 and a polyhedron segment 148. The dial 156 is slideably mounted on the polyhedron segment 148. The dial 156 is disc shaped with a knurled perimeter. This allows a user to easily rotate the dial 156. Rotation of the dial 156 results in rotation of the sleeve 140 relative to the center rod 142.

The threaded segment 146 of the sleeve 140 is inserted through the circular guide 134 of the WCE arm 130 and threadedly engages the circular hole 136 of the WCE arm 130. Accordingly, rotation of the dial 156 and sleeve 140 results in linear (i.e., axial) movement of the WCE arm 130 as the threads on the circular guide 134 of the WCE assembly engage the complimentary threads of the threaded segment 146 of the sleeve 140.

Figure 6:
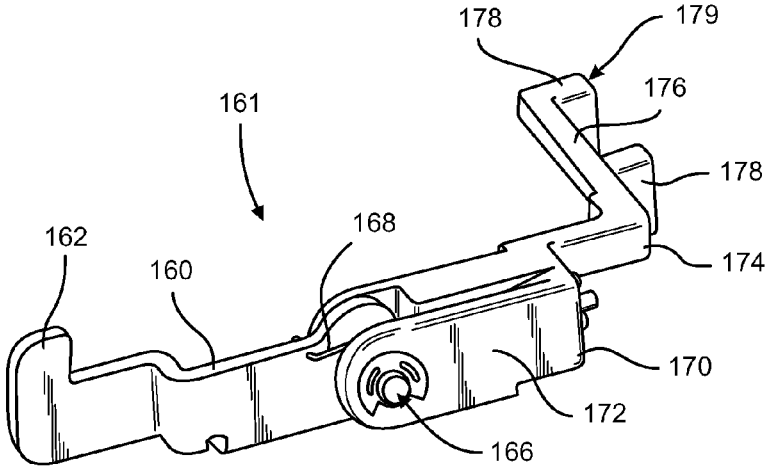
FIG. 6 depicts a perspective view of a lockout and blocking assembly isolated from the other elements of FIG. 2.

With reference now to FIGS. 2 and 6, the depth adjustment mechanism 141 is rotatably coupled to a lockout and blocking assembly 161. As best seen in the isolated view of FIG. 6, the lockout and blocking assembly 161 includes a lockout member 160 and a blocking member 170. As explained in further detail below, the lockout member 160 is configured to prevent the WCE 120 from being depressed when the magazine 104 is empty or substantially empty of fasteners. As also explained in further detail below, the blocking member is configured to prevent the driver assembly from actually firing a fastener if the WCE 120 is not depressed.

In the embodiments disclosed herein, the lockout member 160 is provided as an arm that pivots relative to the WCE assembly 121 about a pivot shaft 166. Accordingly, the lockout member may be referred to herein as a "pivot arm" 160. The blocking member 170 is provided as an arm that is connected to the WCE assembly 121 in a non-pivoting manner. Accordingly, the blocking member may be referred to herein as a "blocking arm" 170. The pivot arm 160 and blocking arm 170 are both configured to move in a linear direction along with the WCE 120 when the WCE moves between the extended position and the depressed position.

Figure 7:
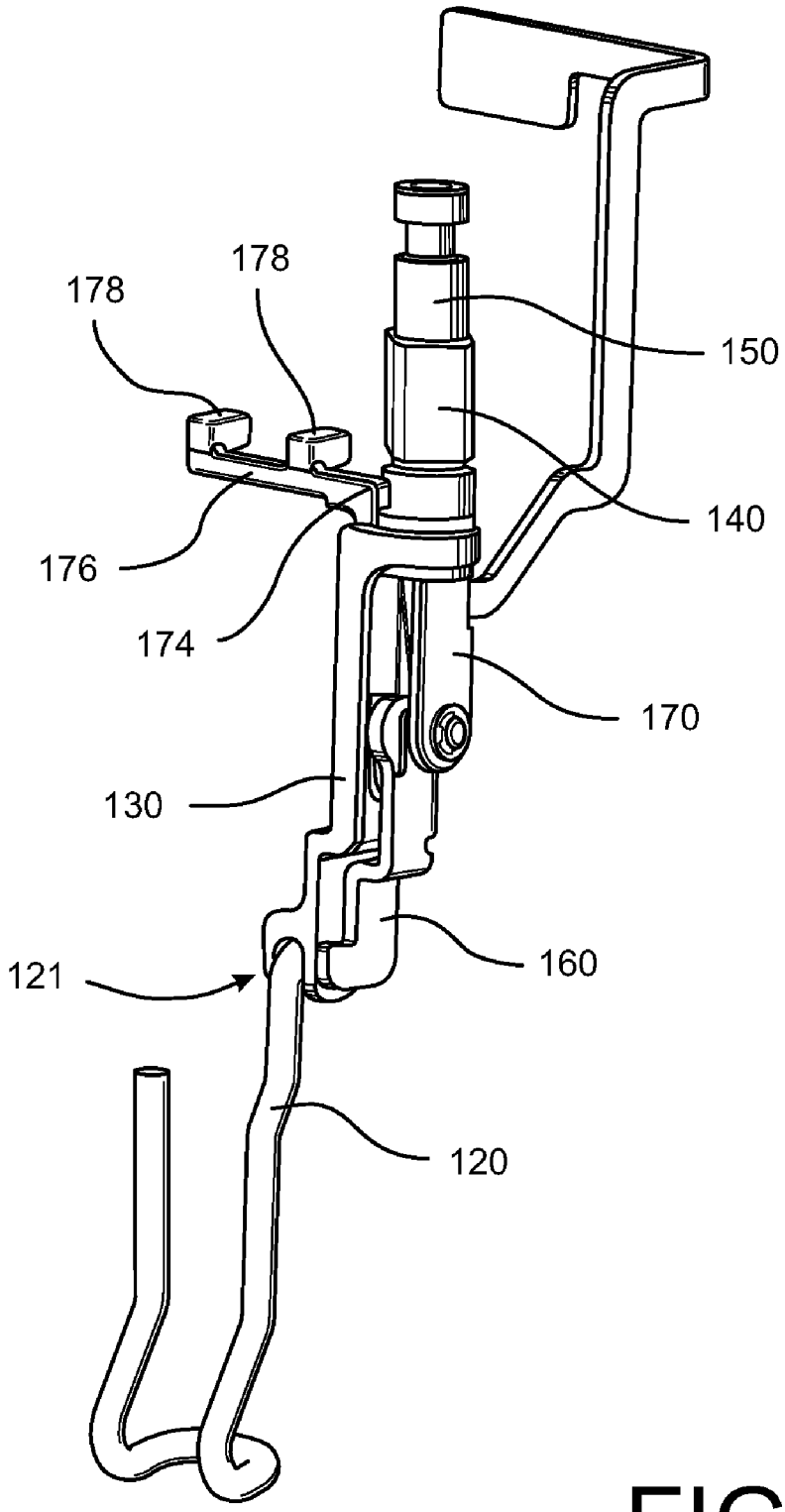
FIG. 7 depicts a perspective view of the work contact element assembly connected to the depth adjustment mechanism of FIG. 5 and the lockout and blocking assembly of FIG. 6.

The blocking arm 170 includes a body portion 172 with an elbow 174 extending from the body portion 172. The elbow 174 is connected to an extension portion 176 that protrudes outward from the body portion 172 in a generally perpendicular manner. Two blocking fingers 178 are positioned on the extension portion 176. The blocking fingers 178 protrude outward from the extension portion 176 in a generally perpendicular manner. When the device 100 is assembled as shown in FIGS. 4 and 7, one of the blocking fingers 178 extends through the opening 138 in the WCE assembly 121. As explained in further detail below, the tips 179 of the fingers 178 provide surfaces that prevent parts of a driver assembly 200 (see FIG. 8) from moving and providing an expulsion force that fires a fastener out of the device 100.

The blocking arm 170 also includes a bore (not show) that is configured to receive the end of the first cylindrical portion 144 of the center rod 142 of the depth adjustment mechanism 141. The end of the first cylindrical portion 144 of the depth adjustment mechanism 141 is secured in the bore of the blocking arm 170 such that the center rod 142 is fixedly connected to the blocking arm 170. The sleeve 140 of the depth adjustment mechanism 141 is rotatably trapped on the center rod 142 between the blocking arm 170 and the second cylindrical portion 150 of the center rod 142. In this manner, the sleeve 140 of the depth adjustment mechanism 141 is rotatably coupled to the lockout and blocking assembly 161. Furthermore, because the WCE assembly 121 is coupled to the depth adjustment mechanism 141, the WCE assembly 121 is therefore also coupled to the lockout and blocking assembly 161, as can be seen with reference to FIG. 7.

With reference again to FIG. 6, the lockout arm 160 is pivotably connected to the blocking arm 170 about the pivot shaft 166. Accordingly, one end of the lockout arm 160 includes a hole that allows the pivot shaft 166 to pass through the lockout arm 160. The opposite end of the lockout arm includes a foot 162 configured to move between a fire position and a lockout position, wherein the foot includes a surface that engages the WCE 120 and blocks the WCE from depressing when in the lockout position. The foot 162 moves to the lockout position when the magazine is low on fasteners.

Figure 8:
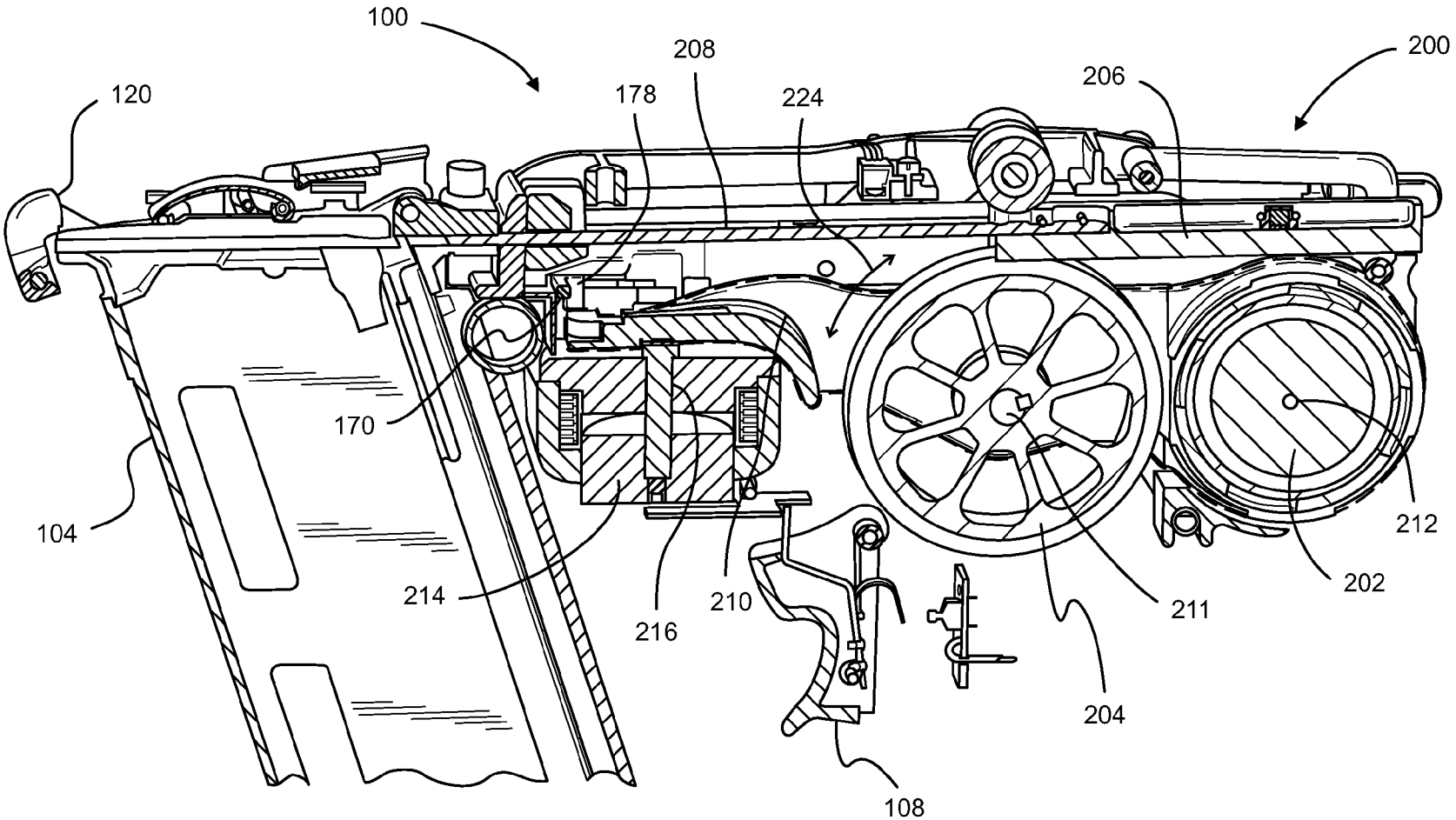
FIG. 8 shows a cutaway side view of a blocking arm of the lockout and blocking assembly of FIG. 7 positioned in the fastener driver in association with a pivoting driver mount.

The lockout arm 160 is pivotable between a rearward "unlocked" position, as shown in FIGS. 2 and 3, and a forward "locked" position, as shown in FIGS. 7 and 8. A spring 168 is mounted on the pivot shaft 166 and biases the lockout arm 160 toward the unlocked position of FIGS. 2 and 3. A spring loaded follower 158 in the magazine 104 forces fasteners toward the nose 114.

In operation, the WCE assembly 121, lockout and blocking assembly 161, and depth adjustment mechanism 141 are all coupled together and work as a unit to provide various features for the device 100. FIGS. 2 and 3 generally show operation of these components when the WCE 120 is moved from the extended position to the retracted position. In FIG. 2, the WCE 120 is in an extended position. When the WCE 120 is moved from the extended position shown in FIG. 2 to the retracted position shown in FIG. 3, the WCE arm 130 moves with the WCE 120 and is retracted in a linear direction into the driver housing 102. The WCE arm 130 is coupled to the sleeve 140 of the depth adjustment mechanism and thus, the sleeve 140 is also moved along with the WCE arm 130. When the sleeve 140 is moved in the linear direction, the blocking arm 170, pivot shaft 166, and pivot arm 160 of the lockout and blocking assembly 161 are also moved in the linear direction. Because the pivot arm 160 is in an unlocked position in FIG. 3 the foot 162 of the pivot arm 160 avoids a flange 116 that is positioned in the nose 114 and fixed in relation to the housing 102. In particular, the foot 162 of the pivot arm 160 is allowed to move past the flange 116 as the WCE 120 is moved to the depressed position. When the pivot arm 160 and connected blocking arm 170 are allowed to move past the flange, the blocking finger 178 is moved to a position that does not block firing of the device 100, as explained in the following paragraphs with reference to FIGS. 8-10.

FIG. 8 shows a side view of the fastener device 100 in order to provide an explanation of the general operation of the device 100. As shown in FIG. 8, the device 100 includes a driver assembly 200 including a DC motor 202, a flywheel 204, a drive block 206, a drive blade 208. The flywheel 204 is positioned on a pivotable drive mount 210 (outlined with dotted lines in FIG. 8) and the flywheel is configured to rotate on the mount about axis 211. The mount 210, in turn, is configured to pivot about a pivot point 212. An actuator in the form of solenoid 214 is configured to engage the drive mount 210 and urge it to move along a pivot path 224 between a first position where the flywheel 204 is removed the drive block 206 and a second position where the flywheel 204 engages the drive block 206. The mount 210 is generally biased (e.g., spring biased) toward the first position and the actuator 214 encourages movement toward the second position.

In operation, a user brings the WCE 120 into contact with a work piece and then pulls the trigger 108 in order to fire a fastener from the device. When the user pulls the trigger 108, the DC motor 202 is energized and transmits power to the flywheel 204 via a drive belt. After a predetermined flywheel speed has been reached, the solenoid 214 is energized. When the solenoid 214 is energized, a plunger 216 associated with the solenoid 214 is moved into contact with the mount 210. The moving plunger 216 then forces the mount 210 and rotating flywheel 204 to pivot toward the drive block 206. When the rotating flywheel 204 comes into contact with the drive block 206, the drive block 206 and connected drive blade 208 are propelled toward the nose. When the drive block 206 and blade 208 are fired, drive blade 208 impacts the fastener positioned at the end of the magazine 104 and expels the fastener from the device 100. A similar arrangement is disclosed in U.S. patent application Ser. No. 12/191,960, the contents of which are incorporated by reference herein in their entirety. Furthermore, although the driver assembly of FIG. 8 includes a DC motor and flywheel, it will be recognized that any of various other drive assemblies are possible.

Figure 9:
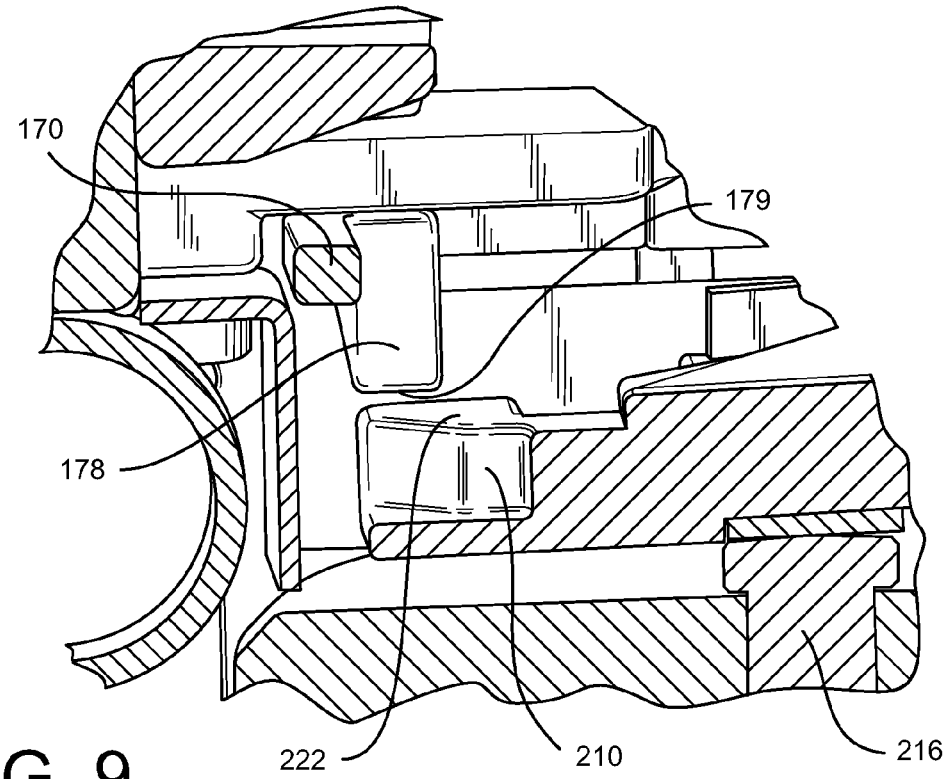
FIG. 9 shows an enlarged view of the blocking arm of FIG. 8 when the work contact element is in an extended position.
Figure 10:
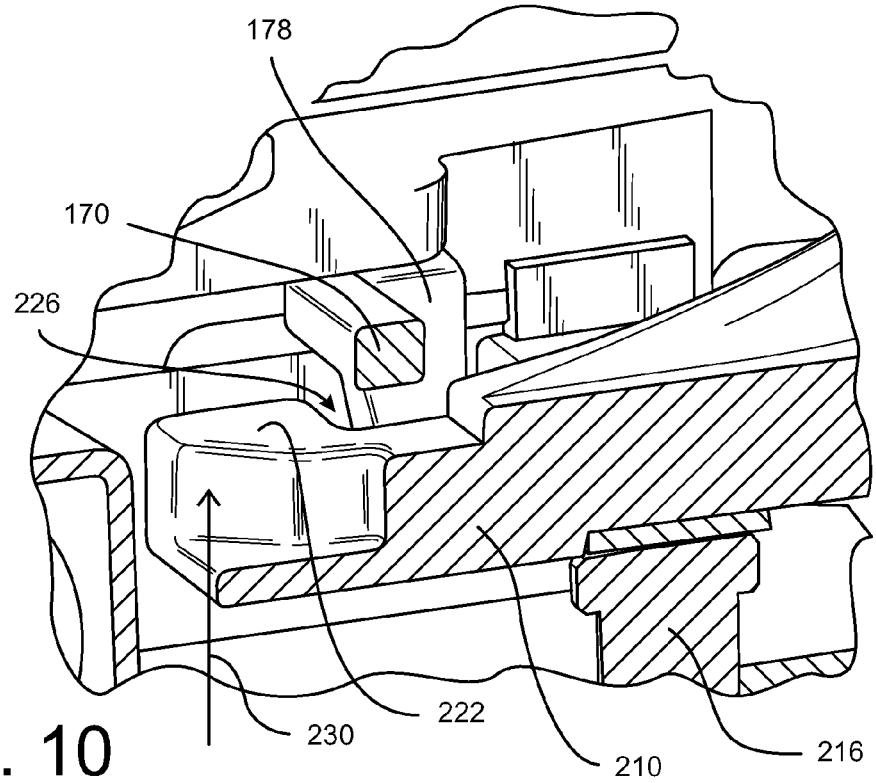
FIG. 10 shows the blocking arm of FIG. 9 when the work contact element is in a depressed position.
Figure 11:
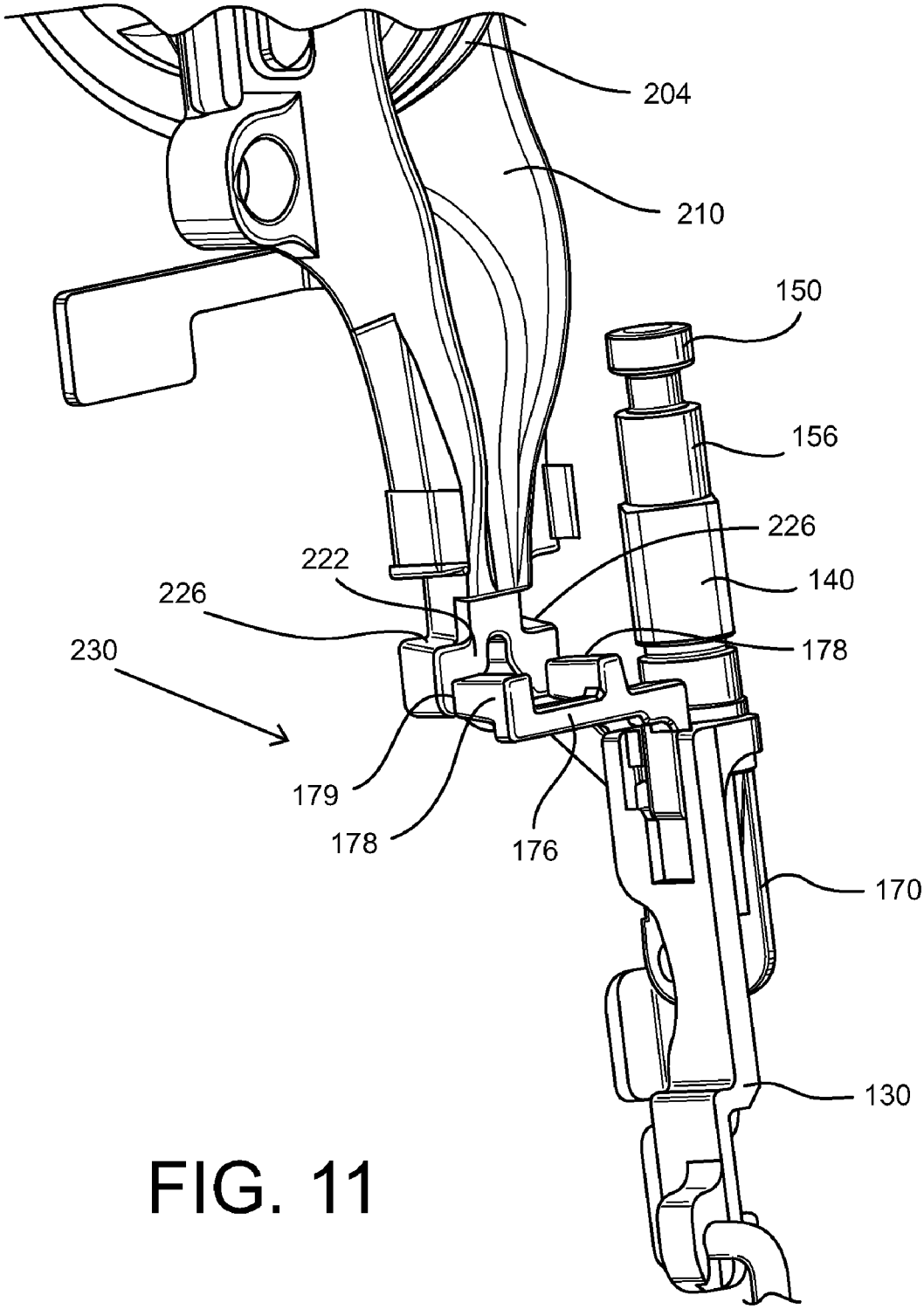
FIG. 11 shows an isolated perspective view of the lockout and blocking assembly of FIG. 7 in relation to the pivotable driver mount when the work contact element is in the extended position.

With particular reference now to FIGS. 9-12, the blocking arm 170 provides a safety feature for the device 100 which prevents the device from firing when the WCE 120 is in the extended position. As shown in FIGS. 9 and 11, when the WCE 120 is in the extended position, the fingers 178 of the blocking arm 170 are positioned in a blocking position that interferes with the pivot path of the mount 210. Thus, if the user pulls the trigger with the WCE 120 in the extended position, the solenoid plunger 216 will contact the mount 210 and urge the mount to move in the direction of arrow 230. However, when this occurs, the tips 179 of the fingers 178 will contact a surface 222 on the driver mount 210 and block the mount 210 from pivoting further toward the drive block 206. Accordingly, when the blocking arm 170 is in the blocking position, the flywheel is prevented from coming into contact with the drive block 206, and the device 100 is blocked from expelling a fastener.

Figure 12:
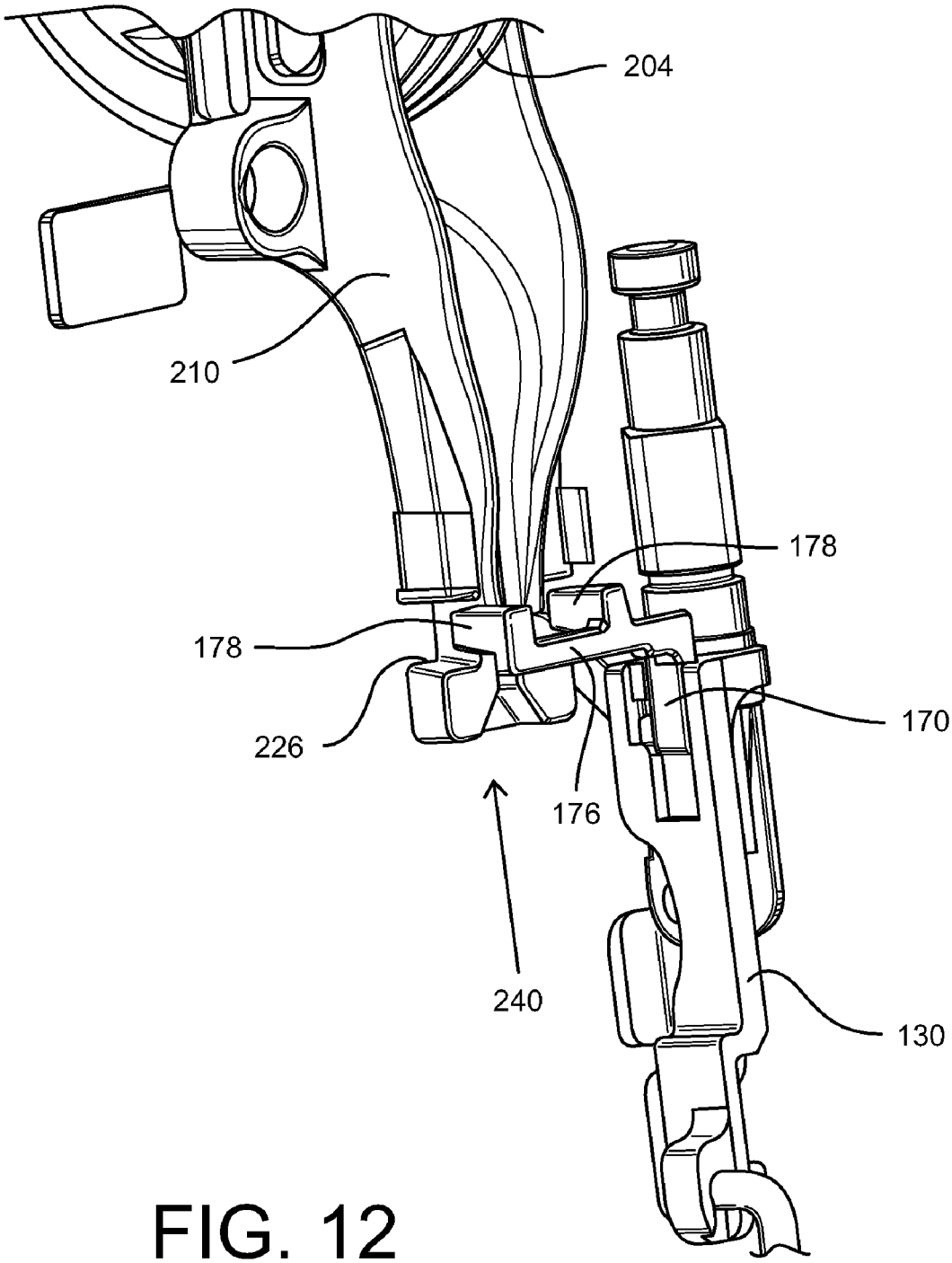
FIG. 12 shows a perspective view of the lockout and blocking assembly of FIG. 11 when the work contact element is in the depressed position.

FIG. 12 shows the position of the blocking arm 170 relative to the mount 210 when the WCE 120 is in the depressed position, but the user has not pulled the trigger 108. In particular, when the WCE 120 is depressed, the blocking arm 170 moves in a linear direction (as indicated by arrow 240 in FIG. 12) to a pass-by position where the locking arm will not interfere with the mount 210 when it pivots along the pivot path. In the embodiment of FIG. 12, the fingers 178 of the blocking arm 170 are aligned with slots 226 in the mount 210 when the locking arm is in the pass-by position. The slots 226 in the mount 210 are designed and dimensioned to receive the fingers 178 such that the fingers 178 will fit into the slots without contacting the mount 210.

Figure 13:
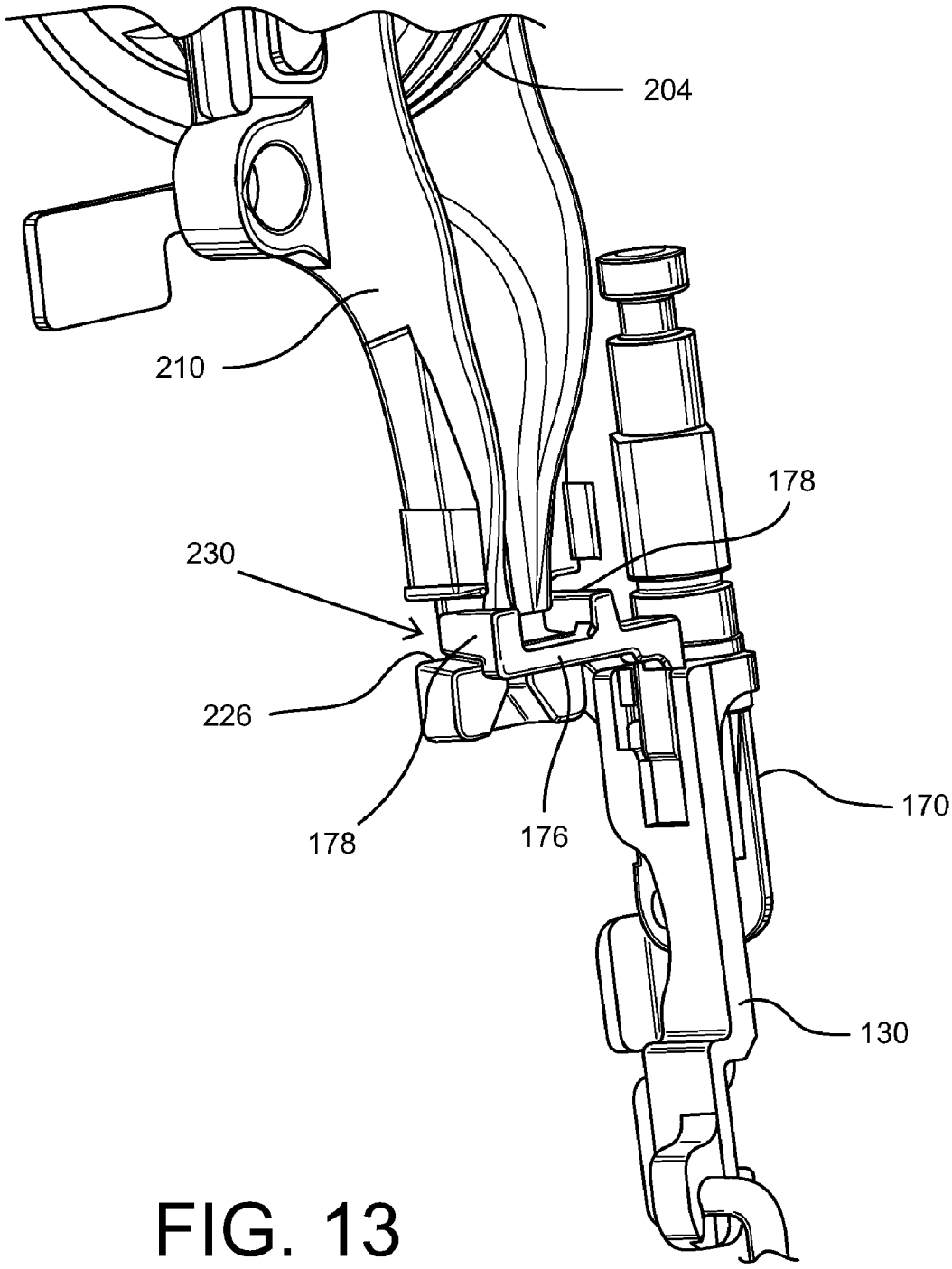
FIG. 13 shows a perspective view of the lockout and blocking assembly of FIG. 12 with the pivotable driver mount moved to a second position.

With the blocking arm 170 in the pass-by position of FIG. 12, the user may then pull the trigger 108, causing the actuator 214 to urge the mount 210 along the pivot path. As shown in FIGS. 10 and 13, when the mount 210 is moved along the pivot path in the direction indicated by arrow 230, the fingers 178 of the locking arm 170 are inserted into the slots 226 in the mount 210, allowing the mount to move the full distance of the pivot path. Thus, when the locking arm 170 is in the pass-by position, it does not interfere with movement of the mount 210, and the flywheel 204 (which is rotatably positioned on the mount 210) may be moved into contact with the driver block 206, causing the device 100 to fire.

While the fastener driver with lockout arm has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A device for driving a plurality of fasteners, the device comprising:

a magazine configured to retain the plurality of fasteners;

a drive blade configured to contact a fastener retained by the magazine;

a driver member configured to impart an expulsion force to the drive blade that propels the drive blade to impact the fastener and expel the fastener from the magazine, the driver member configured to move along a path between a first position where the driver member is spaced apart from the drive blade and prevented from providing an the expulsion force and a second position where the driver member engages the drive blade to impart the expulsion force to the drive blade;

a work contact element moveable in a linear direction between an extended position and a depressed position; and a blocking member connected to the work contact element and configured to move in the linear direction when the work contact element is moved in the linear direction, wherein the blocking member is positioned in the path of movement of the driver member and blocks the driver member from moving to the second position when the work contact element is in the extended position;

wherein the driver member comprises an actuator, a driver mount and a flywheel, the driver mount being movable along the path between the first and second positions, the flywheel being rotatably mounted to the driver mount and configured to impart the expulsion force to the drive blade, wherein the drive blade includes a driver block, wherein the flywheel is spaced apart from the driver block by the driver mount when the driver mount is in the first position, wherein the flywheel is positioned in engagement with the driver block by the driver mount when the driver mount is in the second position, and wherein the actuator is configured to urge the driver mount to move from the first position toward the second position.

2. The device of claim 1 wherein the blocking member is positioned in the path of movement of the driver mount when the work contact element is in the extended position, and wherein the blocking member is configured to move out of the path of movement of the driver mount when the work contact element is in the depressed position.

3. The device of claim 2 further comprising a trigger moveable between a release position and a fire position, the actuator being configured to urge the driver mount toward the second position when the trigger is moved from the release position to the fire position.

4. The device of claim 3 wherein the actuator is a solenoid configured to contact a surface of the driver member.

5. The device of claim 1 wherein the blocking member comprises a blocking arm.

6. The device of claim 5 wherein the blocking arm comprises at least one finger configured for insertion into a slot in the driver mount when the work contact element is in the depressed position and the driver mount is moved from the first position to the second position.

7. A device for driving a plurality of fasteners, the device comprising:

a drive blade movable between a first position where the drive blade is spaced apart from the plurality of fasteners and a second position where the drive blade contacts one of the plurality of fasteners, the drive blade including a drive block attached thereto;

a driver assembly including a flywheel and a driver mount, the flywheel being rotatably mounted to the driver mount, the driver mount configured to move between a first position where the flywheel is removed from the drive block and a second position where the flywheel engages the drive block and propels the drive block and the drive blade from the first position to the second position;

a work contact element moveable between an extended position and a depressed position; and a blocking arm connected to the work contact element and configured to move with the work contact element, wherein the blocking arm is positioned in a path of movement of the driver mount when the work contact element is in the extended position and blocks the driver mount from moving to the second position, and wherein the blocking arm is removed from the path of movement of the driver mount when the work contact element is in the depressed position such that the driver mount is free to move to the second position.

8. The device of claim 7 wherein the driver assembly further comprises an actuator configured to urge the driver mount toward the second position when a trigger is pulled.

9. The device of claim 8 wherein the blocking arm includes a blocking surface configured to engage the driver mount when the trigger is pulled and the work contact element is in the extended position.

10. The device of claim 9 wherein the blocking surface of the blocking arm is configured to avoid engagement with the driver mount when the trigger is pulled and the work contact element is in the depressed position.

11. The device of claim 8 wherein the actuator is a solenoid.

12. The device of claim 7 wherein the blocking arm includes a finger dimensioned to fit in a slot on the blocking arm when the driver mount moves from the first position to the second position.

13. A device for driving a plurality of fasteners, the device comprising:

a drive blade movable between a first position where the drive blade is spaced apart from the plurality of fasteners and a second position where the drive blade contacts one of the plurality of fasteners, the drive blade including a drive block attached thereto;

a driver assembly including a flywheel and a driver mount, the flywheel being rotatably mounted to the driver mount, the driver mount configured to move between a first position where the flywheel is removed from the drive block and a second position where the flywheel engages the drive block and propels the drive block and drive blade from the first position to the second position, the driver mount including a blocking surface;

a work contact element moveable between an extended position and a depressed position; and a blocking arm connected to the work contact element and configured to move between a blocking position when the work contact element is in the extended position and a pass-by position when the work contact element is in the depressed position, the blocking arm including a blocking surface, wherein the blocking surface of the blocking arm is configured to engage the blocking surface of the driver mount and block the driver mount from moving from the first position to the second position when the work contact element is in the extended position, and wherein the blocking surface of the blocking arm is configured to avoid engagement with the blocking surface of the driver mount when the work contact element is in the depressed position.

14. The device of claim 13 wherein the blocking surface of the blocking arm is provided on a finger of the blocking arm configured to fit within a slot on the driver mount when the blocking arm is in the pass-by position.

15. The device of claim 13 wherein the blocking surface of the blocking arm is provided on a finger of the blocking arm configured to engage a surface of the driver mount when the blocking arm is in the blocking position.

16. The device of claim 13 wherein the driver assembly further comprises an actuator configured to urge the driver mount toward the second position when a trigger is pulled.

* * * * *